US007089623B1

(12) United States Patent
Mäkipää et al.

(10) Patent No.: US 7,089,623 B1
(45) Date of Patent: Aug. 15, 2006

(54) APPARATUS FOR CLEANING CHANNELS FOR AIR CONDITIONING AND OTHER PURPOSES

(75) Inventors: Vesa Mäkipää, Helsinki (FI); Kauko Salomäki, Nukari (FI); Markku Viinikainen, Hamburg (DE)

(73) Assignee: Oy Lifa Iaq LTD, Helsinki (FI)

( * ) Notice: Subject to any disclaimer, the term of this patent is extended or adjusted under 35 U.S.C. 154(b) by 374 days.

(21) Appl. No.: 10/130,869

(22) PCT Filed: Nov. 16, 2000

(86) PCT No.: PCT/FI00/01005

§ 371 (c)(1),
(2), (4) Date: Jun. 17, 2002

(87) PCT Pub. No.: WO01/38016

PCT Pub. Date: May 31, 2001

(30) Foreign Application Priority Data

Nov. 23, 1999 (FI) ..... 19992494

(51) Int. Cl.
*B08B 9/35* (2006.01)
*B08B 9/04* (2006.01)
*B08B 9/047* (2006.01)

(52) U.S. Cl. ..... 15/304

(58) Field of Classification Search ..... 15/104.05, 15/104.066, 104.067, 104.09, 104.095, 104.12, 15/302, 304, 353, 347; 55/372, 374
See application file for complete search history.

(56) References Cited

U.S. PATENT DOCUMENTS 2,532,933 A * 12/1950 Nuffer ..... 55/374
2,564,845 A * 8/1951 Holt, Jr. ..... 55/493

FOREIGN PATENT DOCUMENTS

CH 681 141 1/1993
FR 2802450 * 6/2001

(Continued)

OTHER PUBLICATIONS

Pages 1.6 and 1.7 of "Gear Process Theory" from The Gleason Works 1991.*

(Continued)

*Primary Examiner*—Terrence R. Till
(74) *Attorney, Agent, or Firm*—Smith-Hill and Bedell

(57) ABSTRACT

The present invention concerns an arrangement for cleaning ducts and chimneys, such as air conditioning ducts. The arrangement comprises a guide wire cable having a cleaning end and a feed end, a brush or some other tool being connected to the cleaning end of the guide wire cable, and a drive unit connected to the feed end of the guide wire cable, the arrangement further comprising transmission means for moving the brush by means of the drive unit. According to the invention the drive unit comprises a hydraulic pump, the transmission means are provided by hydraulic pipes arranged inside the guide wire cable, and the primary drive unit for the brush being a hydraulic motor connected to the cleaning end of the guide wire cable.

9 Claims, 7 Drawing Sheets

U.S. PATENT DOCUMENTS

| | | | | | |
|---|---|---|---|---|---|
| 3,012,347 | A | * | 12/1961 | Braun | 38/2 |
| 4,523,936 | A | * | 6/1985 | Disanza, Jr. | 55/429 |
| 4,811,453 | A | * | 3/1989 | Lubraniecki | 15/347 |
| 5,230,723 | A | | 7/1993 | Travis et al. | |
| 5,438,729 | A | | 8/1995 | Powell | |
| 5,724,701 | A | | 3/1998 | Jones | |
| 5,813,089 | A | * | 9/1998 | Nolan et al. | 15/383 |
| 5,875,508 | A | * | 3/1999 | Hale | 15/104.31 |

FOREIGN PATENT DOCUMENTS

| | | | |
|---|---|---|---|
| JP | 2000-61420 | * | 2/2000 |
| WO | 92/01121 | | 1/1992 |
| WO | 96/36445 | | 11/1996 |

OTHER PUBLICATIONS

Patent Abstracts of Japan, Publication No. 02-119982, Published May 8, 1990.

* cited by examiner

APPARATUS FOR CLEANING CHANNELS FOR AIR CONDITIONING AND OTHER PURPOSES

CROSS REFERENCE TO RELATED APPLICATION

This is a national stage application filed under 35 USC 371 based on International Application No. PCT/FI2000/001005 filed Nov. 16, 2000, and claims priority under 35 USC 119 of Finnish Patent Application No. 19992494 filed Nov. 23, 1999.

BACKGROUND OF THE INVENTION

The invention related to an arrangement for cleaning ducts and passages, such as air-conditioning ducts or chimneys.

The invention also relates to a receiver unit and a transverse workhead which are part of the arrangement.

According to the prior art, cleaning apparatuses and methods are used where a brush at the end of a long guide wire cable is inserted into the duct to be cleaned. The brush is moved inside the duct and for enhanced cleaning effect it is rotated or caused to make jerking movements. An alternative solution involves a technique based on intense compressed-air blasting where the cleaning end progresses inside the duct by means of compressed air. Even compressed-air turbine brushes are known. During cleaning, an intense underpressure is created in the duct system which during brushing enables the removal by suction of loose dirt from the system. The rotational or jerking movement of the brush is achieved either by an electric or pneumatic drive, whereby the electrically or pneumatically driven motor is connected to the brush and the drive force is transmitted to the motor along the guide wire cable by means of electric or pressure lines. Solutions are also known where a flexible shaft rotates inside the guide wire cable, whereby the motor generating the drive force is situated at the opposite end of the guide wire cable with regard to the brush. The loose dirt from the duct system is led to outdoor air either without filtration or after prefiltration or, alternatively, it is released into the indoor air after filtration.

The prior art is hampered by several drawbacks. Particularly in the case of large duct diameters, great output capacity, adjustable rotational velocity and great driving torque are required of the drive unit to rotate and move the large brush in the desired manner.

Particularly when extensive air conditioning systems are being cleaned, the cleaning efficiency required is so high that the motor size and thereby weight of electric motor drives become too extensive to allow sensible movement of the motor on the guide wire cable. As the space to be cleaned is in practice filled by a mixture of dust and air, sparking of the electric motor inside the space to be cleaned constitutes a severe risk of fire and explosion. In addition, the duct system, which usually is made of an electrically conductive material, is problematic in combination with electric drives, as the electric lines inside the guide wire cable may in the case of a damaged wire cable short circuit in the duct system being cleaned, whereby there is not only a risk of fire and explosion but also of electric shock.

Pneumatic drives arc also hampered by several drawbacks. In order to achieve the power required for large duct systems, pneumatic compressors of such external dimensions are required that they must usually be arranged outside the building being cleaned. Such large compressors are either driven by combustion motors or alternatively, they require three-phase current which is not available in all real properties. Pneumatic compressors and motors are relatively loud and the pneumatic hoses required by the system are awkwardly moved inside the buildings. In addition, in pneumatically driven systems lubricating oil from the motor is spread into the duct system to be cleaned along with the compressed air. The oil spread into the duct system gives rise to odour nuisance and accelerates refouling of the pipes because the oil acts as an effective adhesion surface for the dirt particles.

Solutions based on a mechanical flexible shaft for their part are extremely heavy at the power levels required, and furthermore, the guide wire cable will easily be too loose to be inserted into the duct by pushing. Hereby the resulting friction is also excessive for the motor and transmission.

The prior art is further hampered by the aftertreatment of the dirt removed from the duct system. If the outlet air is prefiltered, some larger solid particle may break the filter system used at present, because the intense underpressure exerts intense suction moving all sizes of dirt particles toward the filter at high speeds. If, then, no filtration is performed, substances which are detrimental to health may spread into the environment.

The prior art is limited to the cleaning of air-conditioning ducts only and offers no means for cleaning planar surfaces or for treating such surfaces without dust nuisance. If the surface to be treated contains health-endangering substances, use of the prior art equipment may cause health detriments unless the workers protect themselves in the required fashion.

The present invention aims at eliminating the drawbacks hampering the prior art and at achieving an entirely novel type of system and method for cleaning air-conditioning ducts and other duct systems and chimney systems. A further aim is to apply the invention to dustfree cleaning and working of planar surfaces.

The invention is based on hydraulically generating the drive force for rotating the cleaning brush along the guide wire cable. According to a preferred embodiment of the invention, the loose dirt is collected into a receiver unit and the air exiting the receiver unit may then be after-filtrated. Further according to an advantageous embodiment of the invention, a transverse workhead equipped with a bevel gear and a suction hood is used for treating essentially planar surfaces.

SUMMARY OF THE INVENTION

The invention offers considerable benefits.

The problems related to fire safety and electrical security hampering electrical drives are avoided thanks to the hydraulic drive. In addition, the motor connected to the brush can be designed much lighter and more compact.

Compared to a pneumatic solution, the use of a sizable, costly, noisy and awkwardly operated compressor is avoided. In addition, oiling of the duct system to be cleaned is eliminated, because a hydraulic system can in practice be constructed fully liquid tight. Possible risks of leakage may be minimized by using a biodegradable hydraulic oil and by providing any parts which are leakage-prone with leak protection such as thermocontractible protective sleeves.

The hydraulic drive according to the invention offers very silent operation.

Due to the receiver unit, an improved cleaning result and enhanced dirt removal are achieved. The receiver unit cannot be broken even by collisions of large particles of dirt.

The transverse workhead according to the invention, then, enables dustfree cleaning or other treatment of even planar surfaces.

BRIEF DESCRIPTION OF THE DRAWINGS

In the following, the invention is described in more detail by means of a working example/examples and with reference to the annexed drawings.

DETAILED DESCRIPTION

Figure 1:
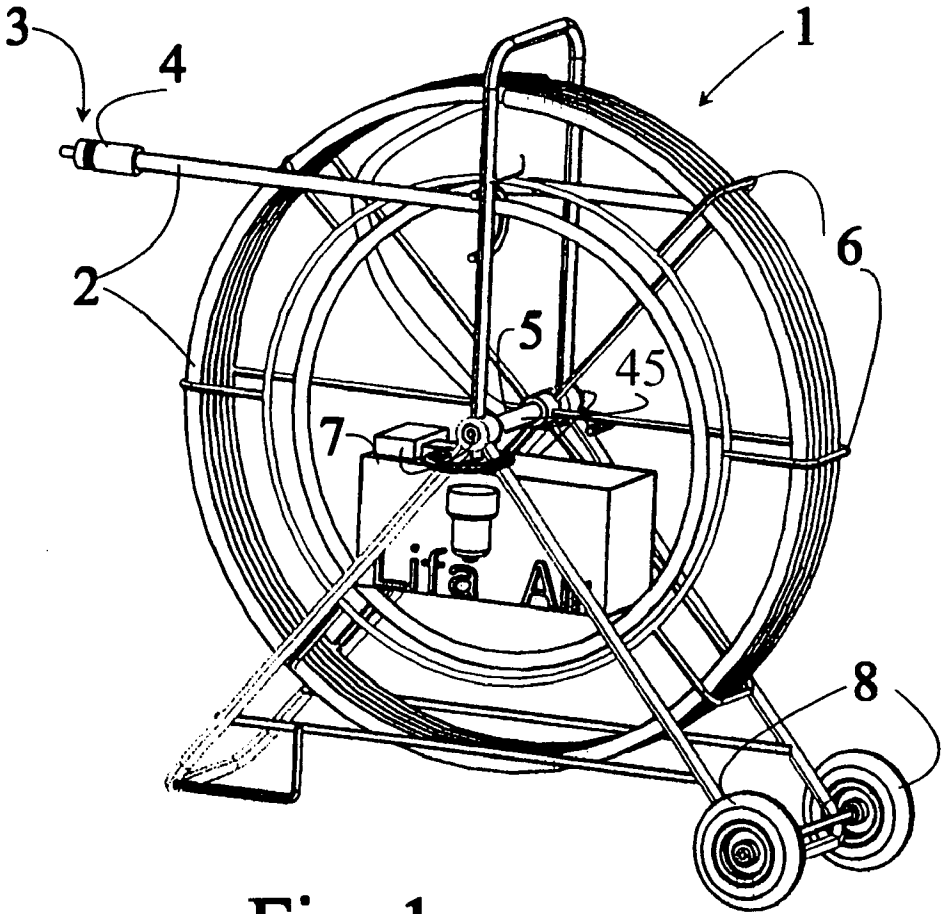
FIG. 1 is a perspective representation of a cleaning arrangement according to the invention.

In the description the invention below, the following terminology with corresponding reference numberals will be used:

1 cleaning arrangement
2 guide wire cable
3 cleaning end
4 hydraulic motor
5 feed end
6 coil carriage
7 hydraulic aggregate
8 wheels
9 radial brush
10 transverse workhead
11 suction connector
12 cylinder brush
13 hood
14 herringbone gear
15 suction pipe
16 receiver unit
17 receiver bag
18 inner casing
19 outer casing
20 flow distributor cover
21 inlet connector
22 underpressure connector
23 suction pipe
24 underpressure unit
25 exhaust outlet
26 primary shaft
27 secondary shaft
28 gear body
29 electric motor
30 hydraulic pump
31 1st adjustable pressure limit valve
32 2nd adjustable pressure limit valve
33 hydraulic filter
34 1st reverse flow valve
35 2nd reverse flow valve
36 3rd reverse flow valve
37 4th reverse flow valve
38 5th reverse flow valve
39 6th reverse flow valve
40 spring loaded reverse flow valve
41 valve spring
42 bypass flow system of internal circulation
43 wheels
44 sealing/brush strip
45 coil shaft In accordance with FIG. 1, the arrangement 1 for cleaning air-conditioning ducts includes a rack 1 around which the rest of the equipment is assembled. To facilitate cleaning work, the guide wire cable 2 is coiled round the coil carriage 6. The guide wire cable 2 typically has a length of 40 m and a thickness of one inch. Thus, the guide wire cable 2 comprises a cleaning end 3 with a hydraulic motor 4, and a feed end 5 which is connected to the hydraulic aggregate 7 via the shaft 45 of the coil carriage 6. The hydraulic aggregate 7 is thus connected to both ends of the shaft 45. Inside the guide wire cable 2 there are at least two hydraulic pipes connecting the engine 4 to the hydraulic aggregate 7. Thus, one of the hydraulic pipes serves as an inlet and the other as an outlet hose for the hydraulic motor 4. If the running direction of the motor 4 is reversed, the inlet hose is converted into an outlet hose, and vice versa. The hydraulic aggregate 7 is fixedly mounted onto the coil carriage 6, which in turn is mounted on wheels 8 to facilitate moving. The arrangement 1 is exhaustive and requires no external power or drive units.

Figure 2:
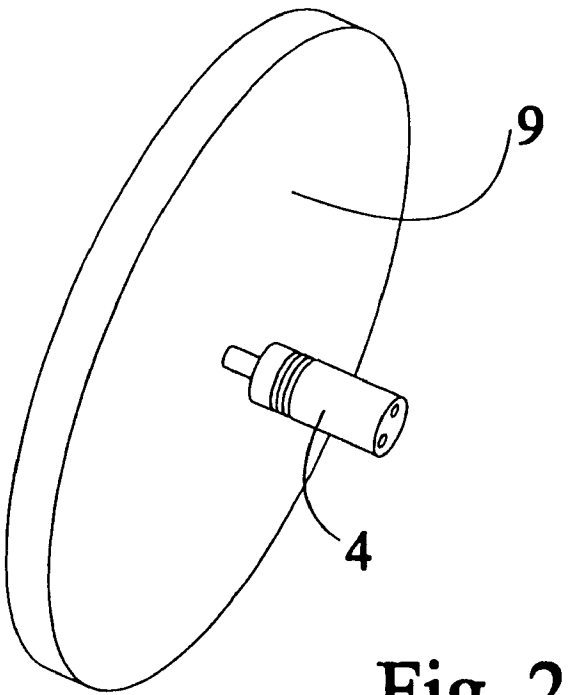
FIG. 2 is a radial brush according to the invention which is compatible with the arrangement of FIG. 1.

FIG. 2 is a schematic representation of a radial brush 9 connected to the hydraulic motor 4. The term 'radial brush' is due to the radial alignment of individual bristles. The brush material may vary from plastic to natural materials to metal or some other suitable material, as is required in each case. The diameter of the brush is mainly selected according to the diameter or sectional surface area of the cleaning target.

Figure 3:
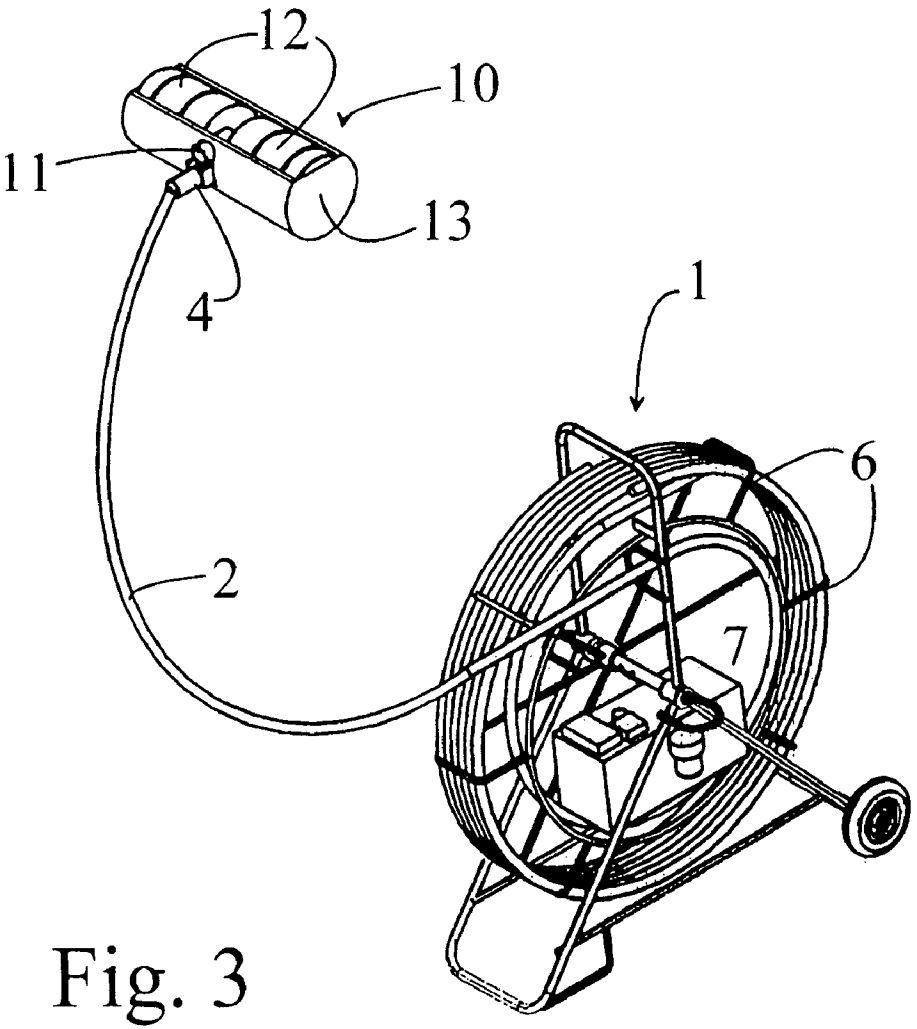
FIG. 3 is a perspective representation of the arrangement of FIG. 1 furnished with a transverse workhead.

FIG. 3 depicts the connection of a transverse workhead 10 to the arrangement of FIG. 1. The transverse workhead 10 comprises a suction hood 13 whose objective is to act as an underpressure chamber to prevent dust from spreading into the surrounding space. The underpressure is provided by means of a suction connector 11. The cylinder brushes 12 which are transverse to the direction of the feed cable are arranged inside the hoods 13 at both ends thereof, and the brushes are driven by the hydraulic motor 4 over a bevel gear.

Figure 4:
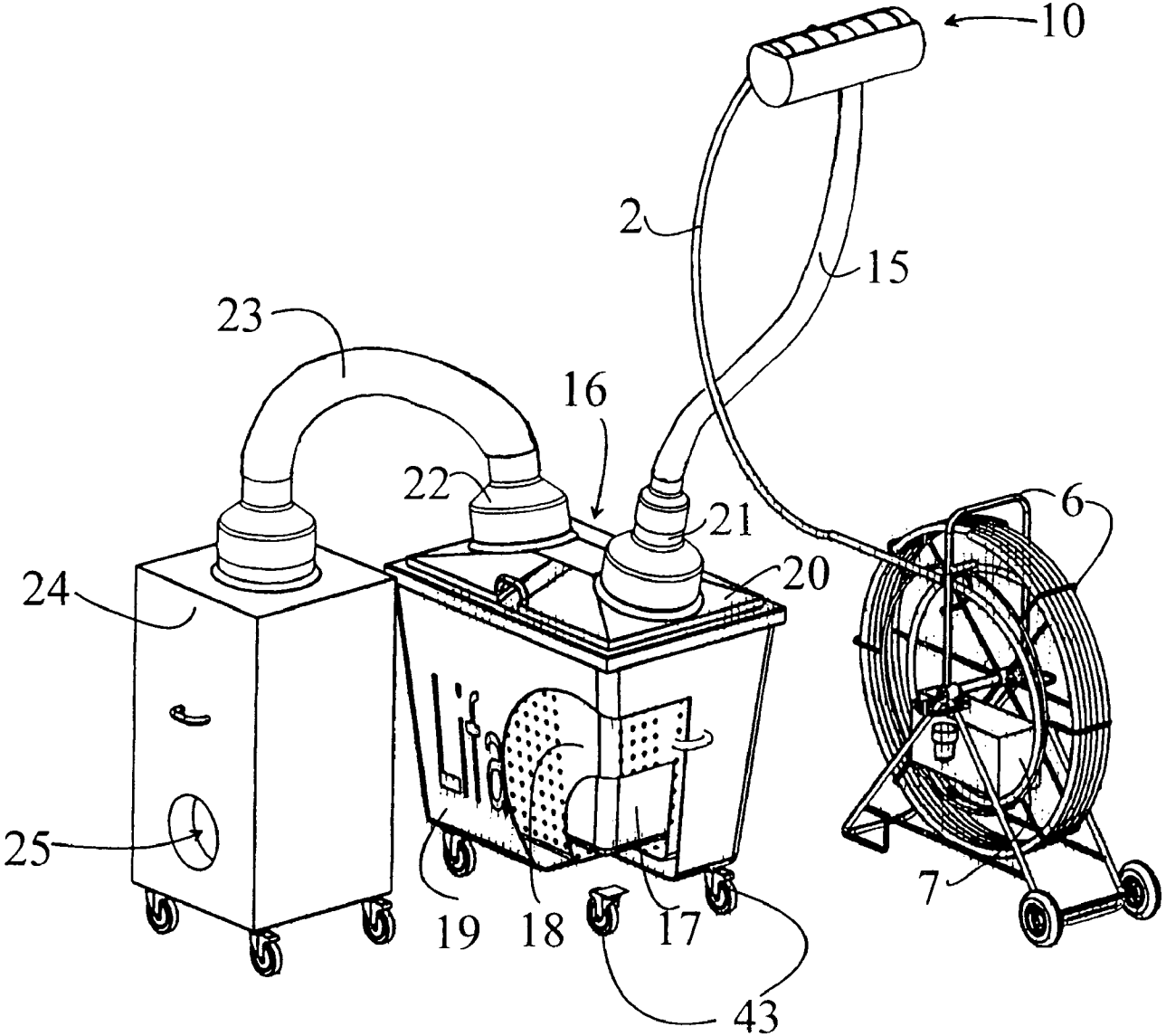
FIG. 4 represents the arrangement of FIG. 3 furnished with a receiver unit according to the invention.

In FIG. 4 the arrangement of FIG. 3 is connected to a receiver unit 16 via a suction pipe 15 and an inlet connector 21, the receiver unit 16 in turn being connected to the underpressure unit 24 via a suction pipe 23. The receiver unit 16 contains a flow distributor cover 20 which forms an underpressure formed from the direction of the underpressure connector 22 between the outer casing 19 and the stiff inner casing 18.

The inner casing is provided with a perforation which distributes the pressure homogeneously to the receiver bag 17. The receiver bag 17 is of a porous, flexible material such as filter cloth which thus serves as dust filter. Thus, it is the underpressure formed between the casings 19 and 18 which causes the receiver bag to be pressed against the surface of the inner casing 18. The receiver unit 16 can be equipped with wheels 43 to improve moving. The receiver unit may have a volume of e.g. 600 liters. Air is removed from the underpressure unit 24 via the outlet 25. Exhaust air can be filtered further after the receiver unit as need be.

Figure 5:
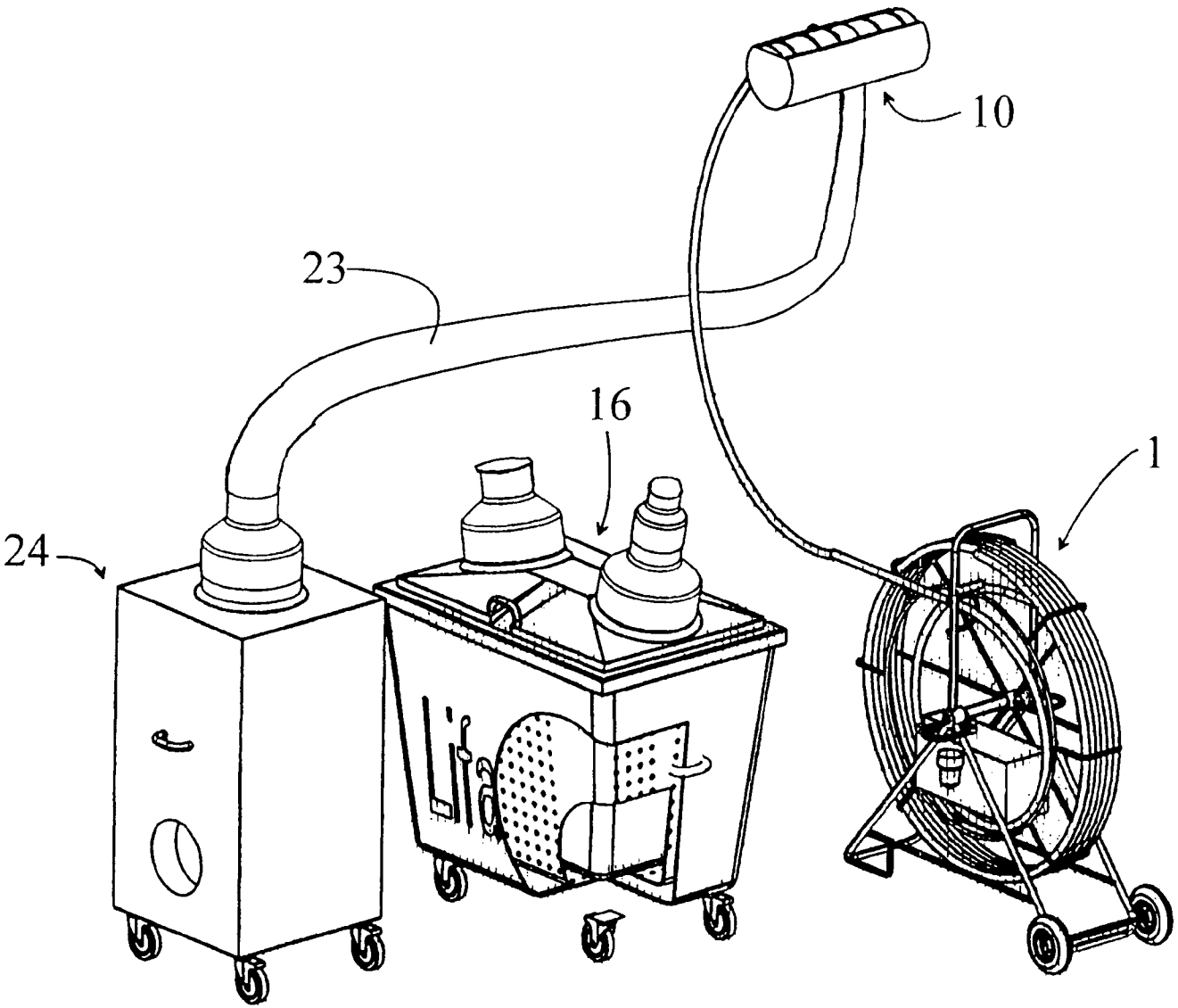
FIG. 5 is a variation on the solution of FIG. 4, where the receiver unit has been skipped.

In the solution depicted in FIG. 5 the receiver unit 16 has been by-passed and the air from the hood 13 of the transverse workhead 10 is sucked directly into the underpressure unit 24. This is feasible e.g. when there is a moderate amount of dirt or when the extracted material is not detrimental to health.

Figure 6:
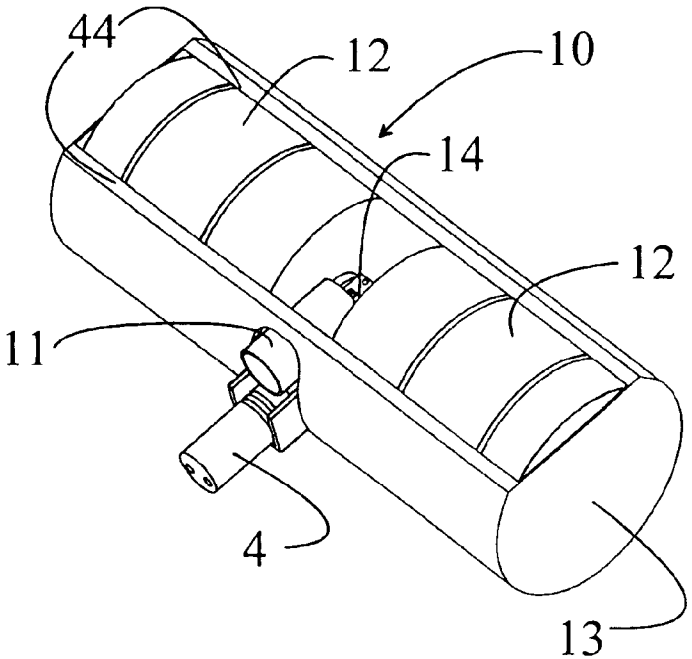
FIG. 6 is a perspective view of the transverse workhead according to the invention.

FIG. 6 depicts the transverse workhead 10 in more detail. The hood 13 is opened at the work area, i.e. at the area of the cylindrical cleaning rolls 12. The underpressure is created via a suction connector 11 and the leakproofness of the hood 13 under operation is enhanced by means of sealing strips 44. The sealing strips 44 may further be equipped with brushes. The motor 4 output is transmitted to the cross-directional cylinders over a herringbone gear 14.

Figure 7:
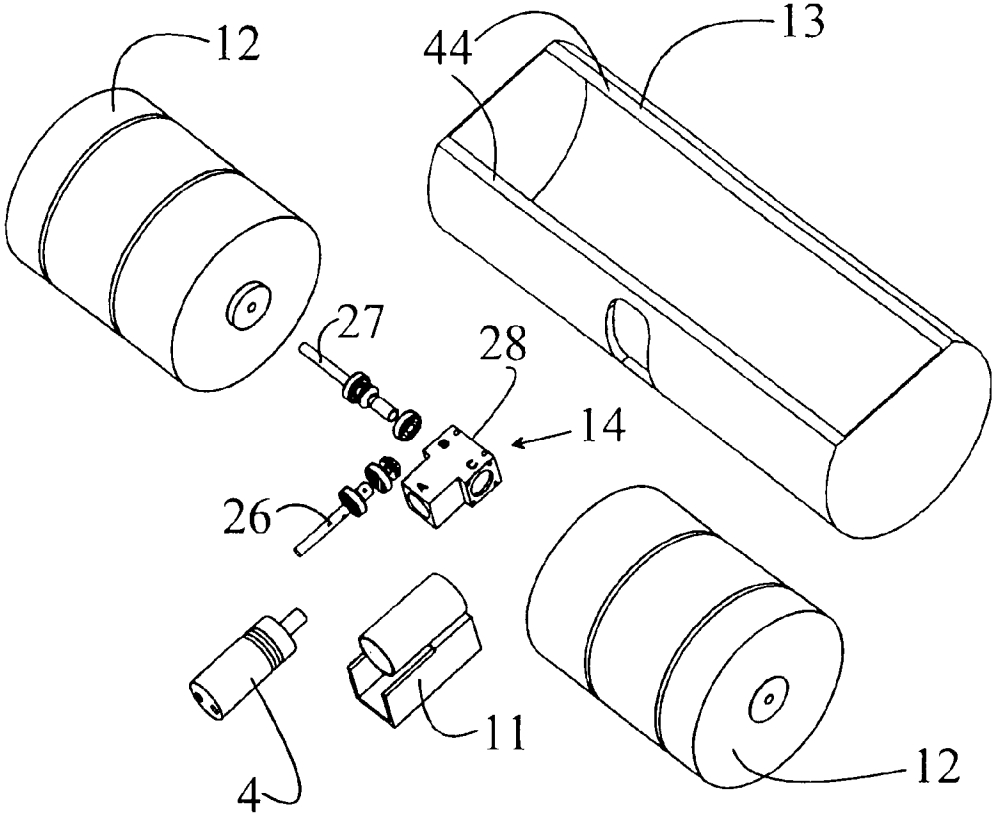
FIG. 7 is an exploded perspective view of the workhead of FIG. 6.

FIG. 7 provides an exploded view of the solution of FIG. 6. The more closely depicted detail is the bevel gear 14 whose longitudinal primary shaft 26, cross-directional secondary shaft 26 and body 28 are shown in more detail.

Figure 8:
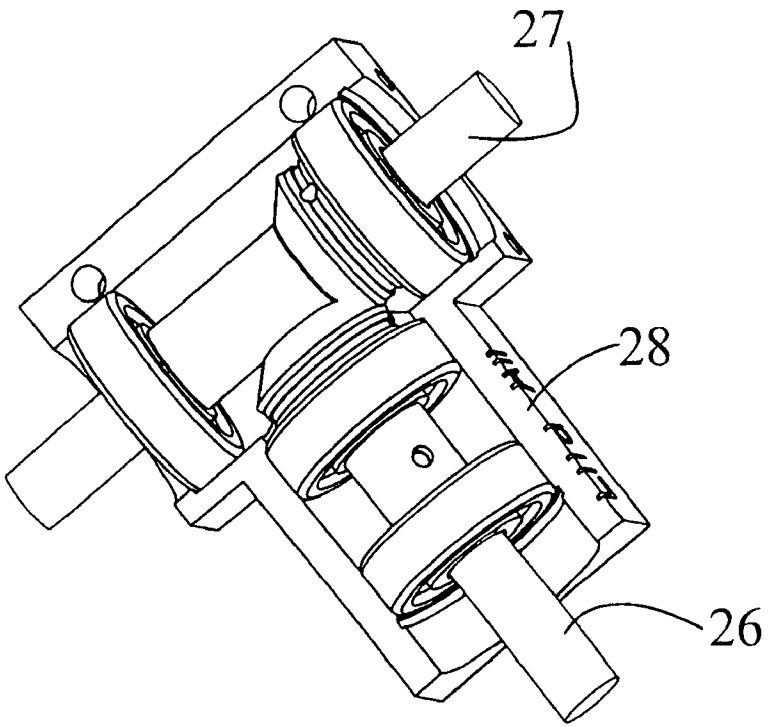
FIG. 8 is a sectional perspective view of the bevel gear of the workhead in FIG. 7.

FIG. 8 provides an even closer view of the bevel gear in its operating position. Due to technical reasons related to drawing, however, the cogging of the gear wheels on the primary 26 and secondary shafts 27 is not shown.

Figure 9:
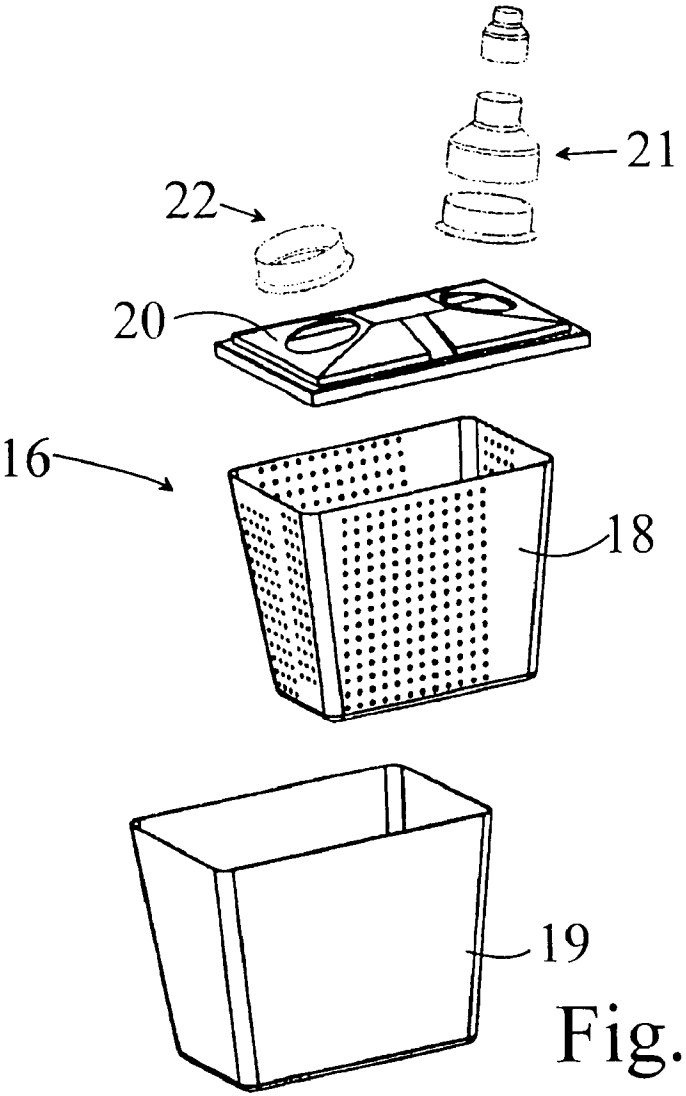
FIG. 9 is an exploded perspective view of the receiver unit of the invention.

FIG. 9 is an exploded view of the receiver unit 16. The internal bag is not shown in this Figure. It would, however, be arranged inside the inner casing 18. The flow distributor cover 20 is encased as a two-layer structure such that suction directed at the aperture of the underpressure connector 22 of the receiver unit is aimed merely at the top edge of the space between the inner casing 18 and the outer casing 19.

Figure 10:
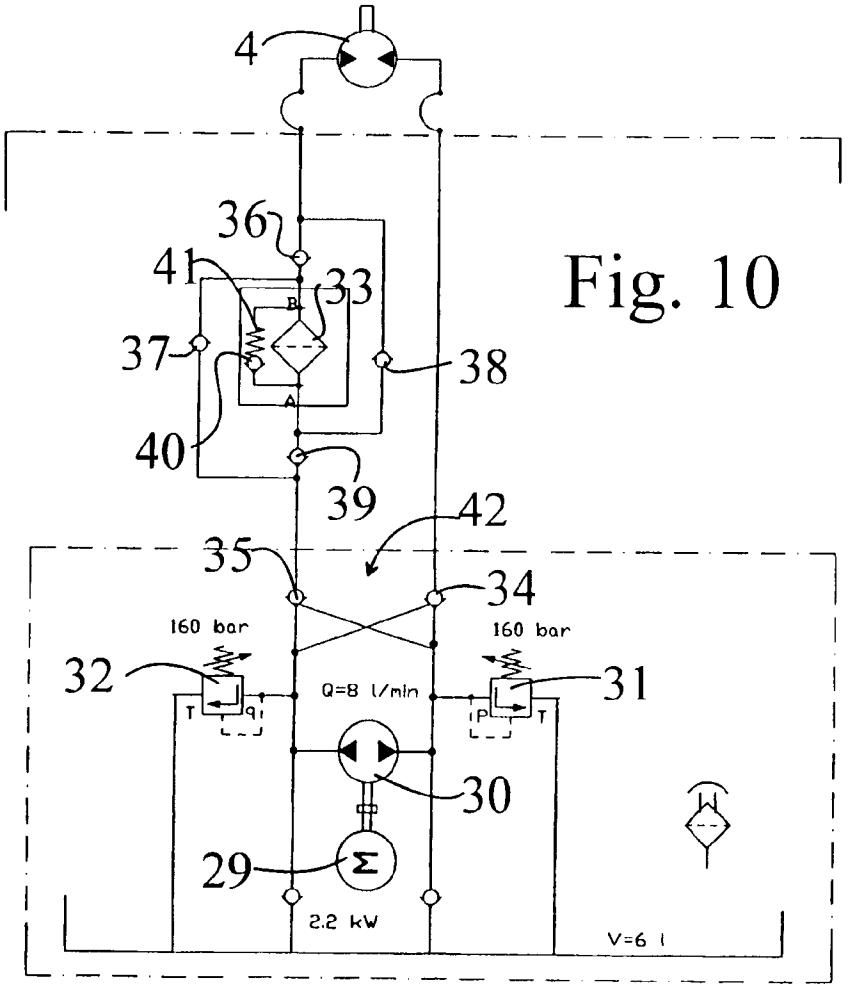
FIG. 10 is a diagrammatic representation of the hydraulic system according to the invention.

FIG. 10 is a schematic hydraulic diagram of an implementation of the hydraulic drive according to the invention. Of the components shown in the diagram, the motor 4 and the hydraulic connectors leading to the motor are clearly outside the hydraulic aggregate 7. The other components are arranged either in the hydraulic unit 7 itself, or they are fixedly mounted in the immediate vicinity thereof.

The heart of the hydraulic unit 7 is an electric motor 27 which provides the drive force and has a power of e.g. 2.2 kW, whereby two-phase current can be used for driving the motor. The motor 27 rotates a pump 30 which converts electrical power into hydraulic power, pressure and flow. The electric motor 29 can be rotated both ways, whereby even bidirectional function of the pump 30 is achieved. Adjustable pressure limit valves 31 and 32 are connected to the system limiting the pressure supplied to the system to 160 bar in the case at hand. The internal circulation is controlled by means of a first 34 and a second 35 reverse flow valve. The system of the invention requires no container for the hydraulic fluid; in a way, the long hose system contained inside the guide wire cable 2 serves as one instead, simultaneously providing efficient hydraulic fluid cooling. A connection is formed around the hydraulic fluid filter 33 by means of reverse flow valves 36 to 40, the connection enabling the required flow direction (in the Figure from the bottom upwards) to the filter 33 independent of the direction of rotation of the pump 30. If, for example, the flow through the motor 4 occurs from the right to the left, the flow will then travel to the filter 33 over the valve 38 and further to the pump 30 over the valve 37. In the case of the reverse flow direction the flow to the motor 4 travels to the filter 33 over the valve 39 and further to the motor 4 over the valve 36. In the case of filter 33 clogging, a flow route is arranged for the hydraulic fluid over the spring-loaded valve 40. The spring-back factor of the spring 41 determines the relief pressure of the valve.

Figure 11:
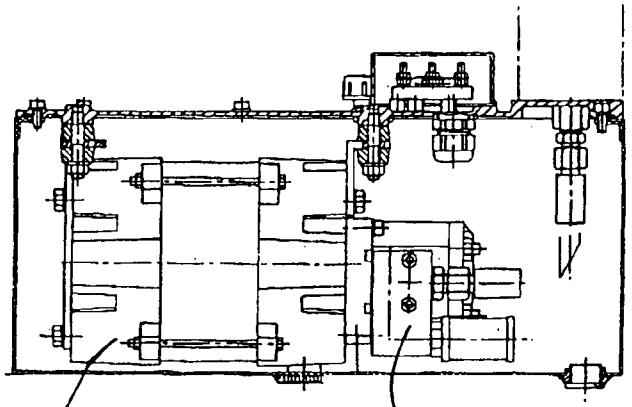
FIG. 11 is a sectional side projection of a hydraulic aggregate according to the invention.
Figure 12:
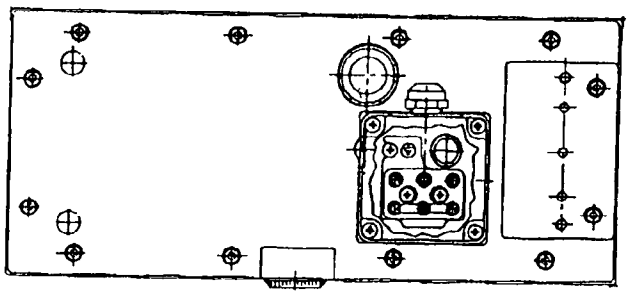
FIG. 12 is a top view of the hydraulic aggregate of FIG. 11.

FIGS. 11 and 12 are provided by way of exemplifying the arrangement of the electric motor 29 and the pump 30 in the hydraulic aggregate.

In the present application the terms duct and passage are used to refer to air-conditioning ducts in particular, but the arrangement according to the invention can be applied to the cleaning of other ducts and chimneys as well.

The drive unit for the hydraulic pump 30 may naturally comprise a drive unit other than an electric motor, such as a combustion motor or a pneumatic motor, but at the moment an electric motor is the preferred alternative due to its silent running and favourable price.

The invention claimed is:

1. An arrangement for cleaning ducts and chimneys, the arrangement comprising:

a guide wire cable (2) with a cleaning end (3) and a feed end (5), whereby a brush (9, 12) or some other tool (10) is connected to the cleaning end (3) of the guide wire cable (2), a drive unit (29, 30) connected to the feed end (5) of the guide wire cable (2), transmission means (2) for moving the brush (9, 12) by means of the drive unit (29, 30), and an underpressure unit for removal by suction of dirt loosened by the cleaning arrangement from a duct system characterized in that the drive unit (29, 30) is a hydraulic pump (30), hydraulic pipes arranged inside the guide wire cable (2) serve as the transmission means, the primary drive unit for the brush (9, 12) is a hydraulic motor (4) connected to the cleaning end (3) of the guide wire cable (2), the arrangement further comprises a receiver unit with a receiver bag, an inner, perforated casing encasing the receiver bag and an outer casing encasing the inner casing, a flow distributor cover which is used to create an underpressure between the inner casing and the outer casing, and a bevel gear connected to the cleaning end of the guide wire cable, the gear permitting changing the direction of the slewing axis of the brush by substantially ninety degrees, and the brush is encased by a hood having a connector and sealing strips for creating an underpressure inside the hood.

2. The arrangement according to claim 1, characterized in that the drive unit for the hydraulic pump (30) is an electric motor (29).

3. The arrangement according to claim 1, characterized in that the arrangement further comprises a rack such that at least in the transporting position the guide wire cable is coiled around the rack.

4. The arrangement according to claim 1, characterized in that two brushes are connected to the bevel gear.

5. An arrangement for cleaning ducts and chimneys, the arrangement comprising:

a guide wire cable (2) with a cleaning end (3) and a feed end (5), whereby a brush (9, 12) or some other tool (10) is connected to the cleaning end (3) of the guide wire cable (2), a drive unit (29, 30) connected to the feed end (5) of the guide wire cable (2), and transmission means (2) for moving the brush (9, 12) by means of the drive unit (29, 30), characterized in that the drive unit (29, 30) is a hydraulic pump (30), hydraulic pipes arranged inside the guide wire cable (2) serve as the transmission means, the primary drive unit for the brush (9, 12) is a hydraulic motor (4) connected to the cleaning end (3) of the guide wire cable (2), a bevel gear is connected to the cleaning end of the guide wire cable, the gear permitting changing the direction of the brush axis of the brush by substantially ninety degrees, and the brush is encased by a hood having a connector and sealing strips for creating an underpressure inside the hood.

6. The arrangement according to claim 5, characterized in that the drive unit for the hydraulic pump (30) is an electric motor (29).

7. The arrangement according to claim 5, characterized in that the arrangement further comprises a rack such that at least in the transporting position the guide wire cable is coiled around the rack.

8. The arrangement according to claim 5, comprising an underpressure unit for removal by suction of dirt loosened by the cleaning arrangement from a duct system characterized in that the arrangement comprises a receiver unit with a receiver bag, an inner, perforated casing encasing the receiver bag and an outer casing encasing the inner casing, as well as a flow distributor cover which is used to create an underpressure between the inner casing and the outer casing.

9. The arrangement according to claim 5, characterized in that two brushes are connected to the bevel gear.

* * * * *